US005941075A

United States Patent [19]

Ansart et al.

[11] Patent Number: 5,941,075

[45] Date of Patent: Aug. 24, 1999

[54] FUEL INJECTION SYSTEM WITH IMPROVED AIR/FUEL HOMOGENIZATION

[75] Inventors: Denis Roger Henri Ansart, Bois le Roi; Gilles Gérard Claude Lepretre, Epinay Sous Senart; Denis Jean Maurice Sandelis, Nangis, all of France

[73] Assignee: Societe Nationale d'Etude et de Construction de Moteurs d'Aviation (SNECMA), Paris, France

[21] Appl. No.: 08/912,815

[22] Filed: Aug. 19, 1997

[30] Foreign Application Priority Data

Sep. 5, 1996 [FR] France ..... 9610823

[51] Int. Cl.[6] ..... F23R 3/14; F02C 1/00

[52] U.S. Cl. ..... 60/748; 60/737; 239/402; 239/424.5

[58] Field of Search ..... 60/748, 737, 740; 239/402, 419, 424.5, 427.3

[56] References Cited

U.S. PATENT DOCUMENTS

| | | | |
|---|---|---|---|
| 2,958,195 | 11/1960 | Dooley . | |
| 3,570,242 | 3/1971 | Leonardi et al. . | |
| 4,263,780 | 4/1981 | Stettler | 60/748 |
| 4,754,600 | 7/1988 | Barbier et al. | 60/737 |
| 5,373,693 | 12/1994 | Zarzalis et al. | 60/748 |

FOREIGN PATENT DOCUMENTS

| | | |
|---|---|---|
| 636 835 | 2/1985 | European Pat. Off. . |
| 1014072 | 8/1952 | France . |
| 1331085 | 8/1963 | France . |
| 2 243 333 | 4/1975 | France . |
| 2 596 102 | 9/1987 | France . |
| 2 272 756 | 5/1994 | United Kingdom . |

*Primary Examiner*—Ted Kim
*Attorney, Agent, or Firm*—Bacon & Thomas, PLLC

[57] ABSTRACT

A system is disclosed for injecting air and fuel into a combustion chamber of a turbojet engine in which the system includes a fuel injector having an axis A, a first radial swirler located rearwardly of the fuel injector having a plurality of first air passages to direct air into the fuel emanating from the fuel injector in a first plane generally perpendicular to the axis A, a housing located rearwardly of the first radial swirler and forming a pre-mixing chamber bounded by a converging-diverging wall forming a venturi with a throat, the housing having a plurality of second air passages forming a second radial swirler to direct air into the pre-mixing chamber forwardly of the venturi throat in a second plane generally perpendicular to the axis A. The housing also has a plurality of third air passages forming an axial swirler, the second passages and the third passages alternating in a circumferential direction around the housing. A bowl member has a flanged portion connected to the housing and is located rearwardly of the housing such that fuel and air emanating from the premixing chamber and air emanating from the axial swirler pass into the bowl member and are subsequently mixed and passed into the combustion chamber, to which the bowl member is attached.

9 Claims, 3 Drawing Sheets

FUEL INJECTION SYSTEM WITH IMPROVED AIR/FUEL HOMOGENIZATION

BACKGROUND OF THE INVENTION

The invention relates to a fuel injection system for a combustion chamber of a gas turbine engine having improved homogenization of the air/fuel mixture.

Gas turbines in aeronautical applications must undergo a wide range of operating conditions and must meet increasingly demanding performance criteria. To achieve such demands requires increasingly difficult trade-offs. Typically such a difficult tradeoff arises by attempts to maintain flame stability under low power operating conditions and the conflicting need to avoid smoke and nitrogen oxides emissions under full power operating conditions. The fuel and air injection system for todays engines must ensure proper combustion under all of the widely varying operating conditions. The only way to achieve these desired operating parameters is to obtain optimal homogenization of the fuel/air mixture while at the same time maintaining an even radial temperature profile at the outlet of the combustion chamber in order to avoid inducing undesirable thermal stresses in the turbine wheels.

French Patent 2 596 102 illustrates, in FIG. 18, a mechanical system for a fuel injector wherein an swirler has a number of ribs bounding an equal number of air intake passages. Alternate ones of the air intake passages form a radial air intake to direct a flow of air around the fuel injection duct to form a first mixture in the combustion chamber bounded by a member having an inner converging-diverging contour. The alternate air passages form axial intakes to direct a flow of air into the rearward periphery of the housing. While generally successful, this structure of the alternating air feed passages restricts the permeability of the pre-mixing swirler.

SUMMARY OF THE INVENTION

A system is disclosed for injecting air and fuel into a combustion chamber of a turbojet engine in which the system includes a fuel injector having an axis A, a first radial swirler located rearwardly of the fuel injector having a plurality of first air passages to direct air into the fuel emanating from the fuel injector in a first plane generally perpendicular to the axis A, a housing located rearwardly of the first radial swirler and forming a pre-mixing chamber bounded by a converging-diverging wall forming a venturi with a throat, the housing having a plurality of second air passages forming a second radial swirler to direct air into the pre-mixing chamber forwardly of the venturi throat in a second plane generally perpendicular to the axis A. The housing also has a plurality of third air passages forming an axial swirler, the second passages and the third passages alternating in a circumferential direction around the housing. A bowl member has a flanged portion connected to the housing and is located rearwardly of the housing such that fuel and air emanating from the pre-mixing chamber and air emanating from the axial swirler pass into the bowl member and are subsequently mixed and passed into the combustion chamber, to which the bowl member is attached.

The present invention provides a injection system with a high-permeability swirler to achieve the desired performance and pollution criteria at all of the different operational modes of the engine. The system is characterized by a first, high-permeability radial swirler located forwardly of a housing having a converging-diverging pre-mixing chamber which is, in turn, located forwardly of a bowl attached to the combustion chamber. The housing forms a second radial swirler which assures homogeneous mixing in the venturi and an axial swirler having outlets that direct air into the bowl. The plurality of second and third swirlers alternate in a circumferential direction about the housing.

DETAILED DESCRIPTION OF THE PREFERRED EMBODIMENTS

Figure 1:
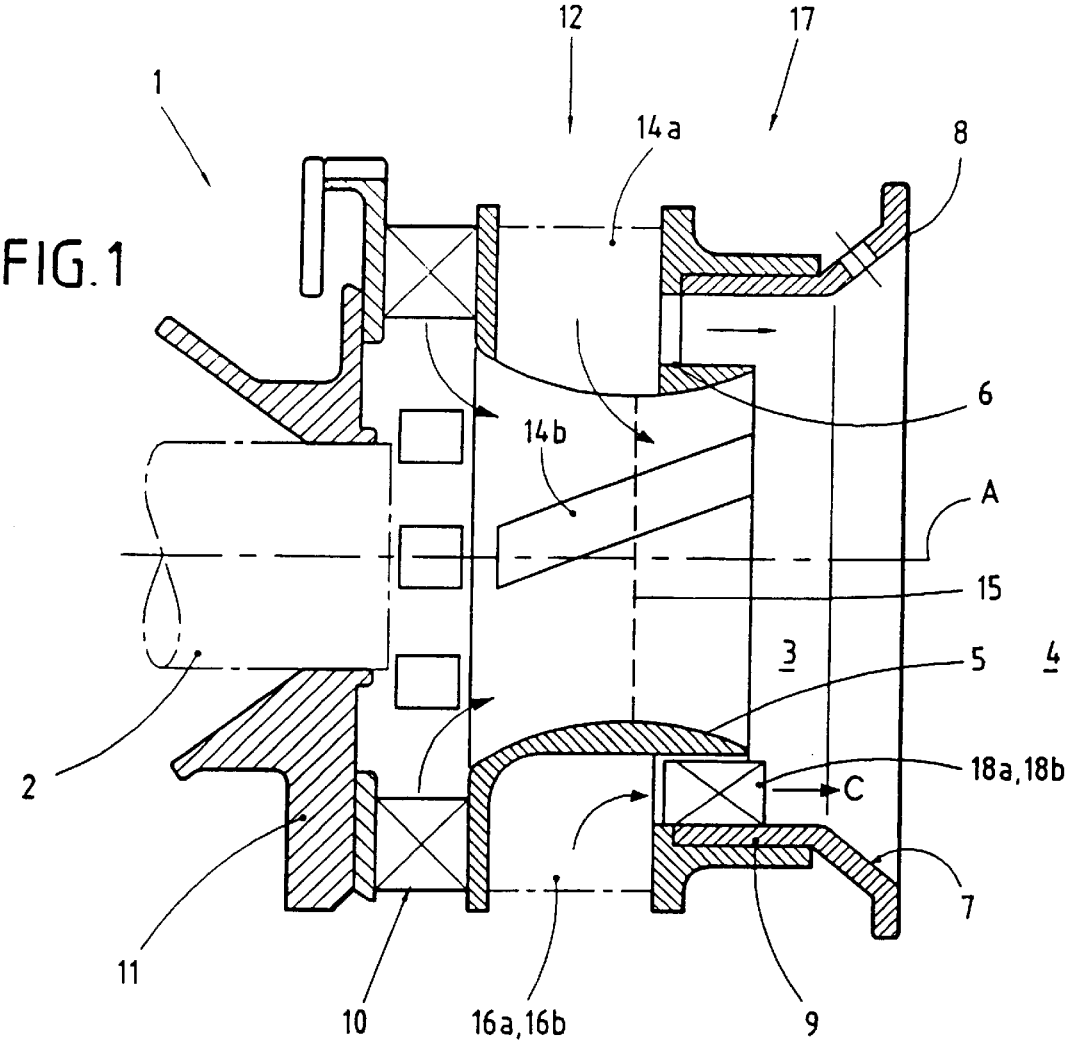
FIG. 1 is a cross-sectional view of a fuel injection system according to the present invention in which the section above the axis A is taken in a plane passing through a second passage illustrating a radial swirler and the section below axis A is taken in a plane extending through a third passage illustrating a cross-section of the axial swirler.
Figure 2:
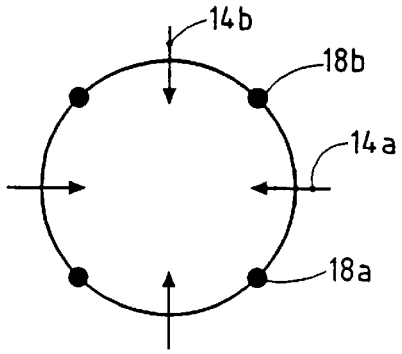
FIG. 2 is a schematic view illustrating the alternating passages of the second radial swirler and the axial swirler.

The fuel injection system 1 according to the present invention comprises a fuel injector 2 having an axis A and which injects a spray of fuel rearwardly (towards the right as illustrated in FIG. 1) into a pre-mixing chamber 3 located forwardly of the primary combustion zone 4. The pre-mixing chamber 3 is bounded by an inner wall 5 of housing 6 and extends substantially co-axially along axis A. The contours of inner wall 5 are extended rearwardly beyond the end of the housing 6 by the outwardly flaring wall 7 of known bowl structure 8. In known fashion, the bowl structure 8 is affixed to an upstream or forward portion of the combustion chamber (not shown). The bowl has a flange portion 9 extending forwardly therefrom which is affixed to the housing 6.

Figure 4:
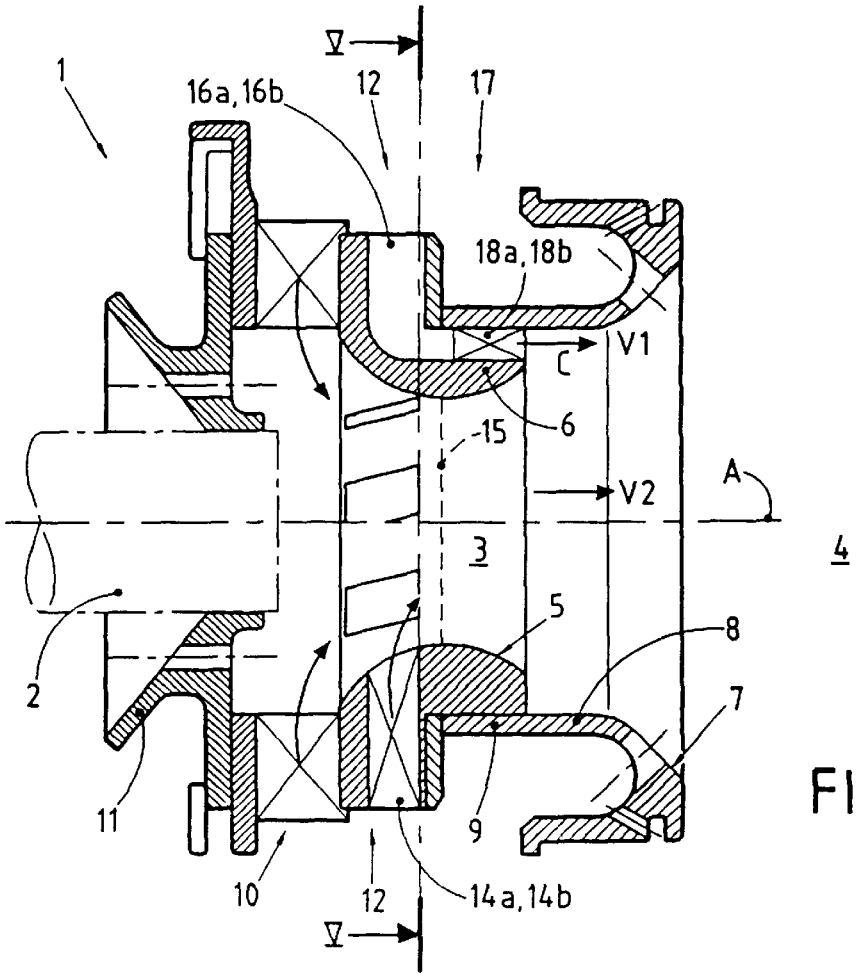
FIG. 4 is a cross-sectional view of a variation of the embodiment illustrated in FIG. 1.

As illustrated in FIGS. 1 and 4, a first radial swirler 10 is located rearwardly of the fuel injector 2 and is typically mounted on a centering ring 11 through which the fuel injector 2 is inserted. The first radial swirler 10 is located forwardly of the housing 6 and directs air radially inwardly toward the fuel emanating from the fuel injector 2 in a first plane which extends substantially perpendicular to axis A.

As can be seen, the contour of inner wall 5 of the housing is a converging-diverging contour to form a venturi having a throat 15. Housing 6 forms two sets of alternating air passages bounded by walls 13, each of the two sets of alternating passages having a generally radially extending portion located forwardly of the venturi throat 15. The first set comprises a plurality of passages 14*a*, 14*b*,. . . which are oriented radially with respect to the axis A such that they form a second radial swirler directing air into the pre-mixing chamber forwardly of the venturi throat 15. The alternating, second set comprises a plurality of passages 16*a*, 16*b*, . . . which also extend generally radially with respect to axis A, but which join with axial passages 18*a*, 18*b*, . . . to direct air in a generally axial direction, indicated by arrow C and in FIGS. 1 and 4, into the bowl structure 8. As illustrated, each of the passages may have a generally rectangular cross-sectional configuration. The axial passages 18*a*, 18*b* are located radially inwardly of the flange portion 9 of the bowl structure. As best illustrated in FIG. 4, the axial passages are located in a rearward portion 17 of the housing 6, while the radially oriented passages 14*a*, 14*b*, 16*a* and 16*b* are located in a forward portion 12 of the fuel injector system. The axial channels 18*a*, 18*b* are located radially outwardly of the converging-diverging wall 5 of the housing 6.

Figure 3:
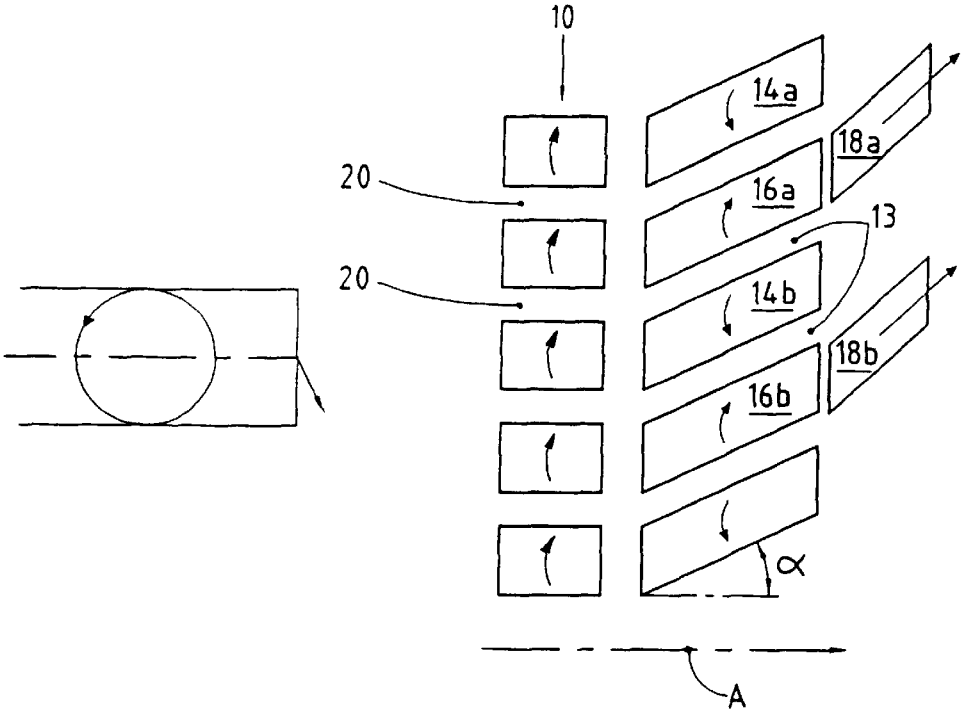
FIG. 3 is a schematic developmental view illustrating the orientations of the two radial swirlers and the axial swirlers relative to the axis A.
Figure 6:
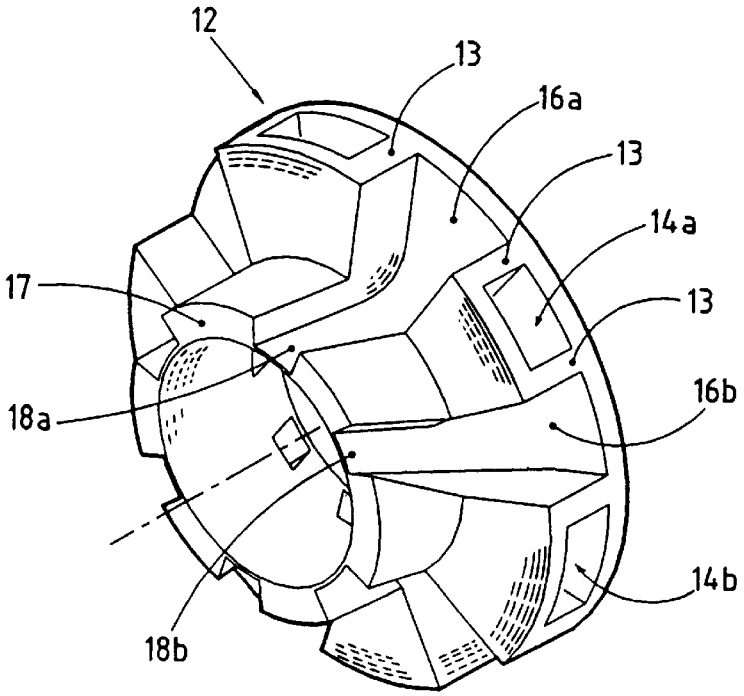
FIG. 6 is a perspective view of the housing forming the pre-mixing chamber utilized in the variation illustrated in FIG. 4.

As illustrated in FIGS. 4 and 6, the passages 16*a*, 16*b*, 18*a*, 18*b* may be formed by generally "U"-shaped channels formed in the housing 6 wherein the axial passages 18*a*, 18*b* are bounded also by the flange 9 of the bowl structure 8. As best illustrated in FIG. 3, the outlets of the passages 18*a*, 18*b* alternate in a circumferential direction with the outlets of the passages 14*a*, 14*b*. Preferably, the number of air passages in the first swirler 10 is equal to the total number of air passages 14*a*, 14*b*, 16*a*, 16*b* located in the forward portion of the housing 6. This renders the first swirler highly permeable to air flow to enable the precise regulation of the fuel/air mixture to achieve the desired operating criteria.

Figure 5:
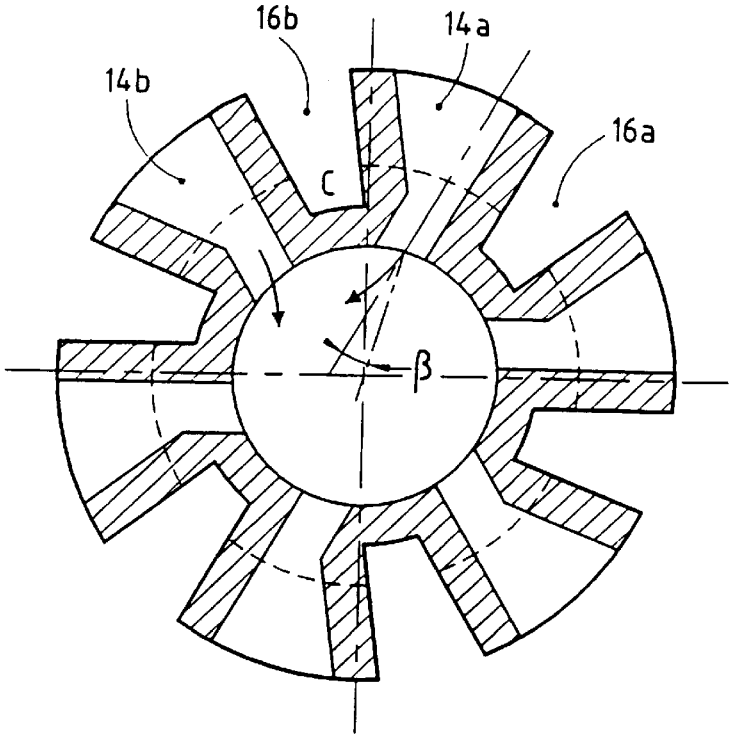
FIG. 5 is a cross-sectional view taken along line V—V in FIG. 4.

The walls 13 extend longitudinally at an angle $\alpha$ with respect to the axis A, as illustrated in FIG. 3. Preferably, the angle $\alpha$ is between 30° and 40°. The outlets of passages 14*a*, 14*b* each have a central axis that extends at an angle $\beta$ relative to a radius extending from the axis A, as illustrated in FIG. 5. As illustrated, angle $\beta$ is an acute angle. The directions imparted to the air passing through these passages by these orientations generate turbulence in the venturi to assure fuel/air mixing homogenization.

The walls 20 separating the passages of the first radial swirler 10 may be oriented radially and preferably impart a circumferential direction to the air passing through these passages that is generally opposite to the circumferential direction of the air emanating from the second swirler passages 14*a*, 14*b*. The first radial swirler 10 implements a first pre-mixing of the fuel and air at the forward end of the pre-mixing chamber 3. Moreover, the first radial swirler 10 may also act as a vent. Preferably, the tangential incidence of the air emanating from the outlets of the second passages 14*a*, 14*b* subtends an angle of between 60° and 90° with the tangential component of the air emanating from the outlets of the first passages in the first air swirler 10.

The orientation of the axial swirler is determined by the directional vanes located adjacent to the outlets of the passages 18*a*, 18*b* which may be oriented at an angle relative to the axis A. Such orientation may direct the air emanating from the axial swirler in the same direction, or in an opposite direction to the circumferential direction of flow of the fuel/air mixture in the venturi to achieve the desired homogenization. The orientation of the vanes in the axial swirler may also depend upon the bowl structure 8, specifically, whether such bowl structure has conventional air intake orifices, has no air orifices, or has a plurality of orifices to swirl the air in the same, or in opposite directions. The ratio of speed of the air injected by the axial swirler to the speed of the mixture at the venturi outlet is preferably between 0.8 and 1.6 and is a function of the bowl technology utilized in each specific application of the invention.

The foregoing description is provided for illustrative purposes only and should note be construed as in any way limiting this invention, the scope of which is defined solely by the appended claims.

We claim:

1. A system for injecting air and fuel into a combustion chamber of a turbojet engine, the system including a fuel injector having an axis A, and comprising a) a first radial swirler located rearwardly of the fuel injector having a plurality of first air passages to direct air into fuel emanating from the fuel injector in a first plane generally perpendicular to the axis A;

b) a housing located rearwardly of the first radial swirler and forming a pre-mixing chamber bounded by a converging-diverging wall forming a Venturi with a throat, the housing having a plurality of second air passages forming a second radial swirler to direct air into the pre-mixing chamber forwardly of the Venturi throat in a second plane generally perpendicular to the axis A, and a plurality of third air passages forming an axial swirler whereby the second passages and the third passages alternate in a circumferential direction around the housing; and, c) a bowl member having a flanged portion connected to the housing and located rearwardly of the housing such that fuel and air emanating from the pre-mixing chamber and air emanating from the axial swirler pass into the bowl member.

2. The injection system of claim 1 wherein each of the plurality of third air passages comprises a generally radial intake portion extending generally radially with respect to the axis A and a generally axial outlet portion extending generally parallel to axis A.

3. The injection system of claim 2 wherein the generally radial intake portions are located forwardly of the Venturi throat.

4. The injection system of claim 2 wherein the generally axial portion are bounded by "U"-shaped channels formed in the housing and by the flanged portion of the bowl which covers the "U"-shaped channels.

5. The injection system of claim 1 wherein the number of first air passages is equal to the total number of second and third air passages.

6. The injection system of claim 1 wherein the first radial swirler imparts rotational movement to air passing therethrough in a first direction about axis A, and wherein the second radial swirler imparts rotational movement to air passing therethrough in a second direction opposite to the first direction.

7. The injection system of claim 1 wherein each of the plurality of second air passages has a longitudinal axis extending at an angle of between 30° and 40° with respect to the axis A.

8. The injection system of claim 1 wherein the plurality of second air passages are oriented such that the tangential incidence of the air emanating from each of the plurality of second air passages forms an angle of between 60° and 90° with the tangential component of the air emanating from each of the plurality of first air passages.

9. The injection system of claim 1 wherein each of the plurality of second air passages has a portion with a central axis extending at an acute angle with respect to a radius from the axis A.

* * * * *